US005528272A

United States Patent [19]

Quinn et al.

[11] Patent Number: 5,528,272

[45] Date of Patent: Jun. 18, 1996

[54] FULL WIDTH ARRAY READ OR WRITE BARS HAVING LOW INDUCED THERMAL STRESS

[75] Inventors: Kraig A. Quinn, Webster; Mark A. Cellura, Fairport; Jeffrey D. Barner, Ontario; Donald J. Drake, Rochester, all of N.Y.

[73] Assignee: Xerox Corporation, Stamford, Conn.

[21] Appl. No.: 166,855

[22] Filed: Dec. 15, 1993

[51] Int. Cl.[6] ..... B41J 2/155

[52] U.S. Cl. ..... 347/42

[58] Field of Search ..... 347/20, 42, 49, 347/50, 63, 18, 237, 238, 209; 257/724; 29/739, 740, 464, 834; 361/760, 771; 156/241, 291, 299; 437/209; 346/139 C, 139 A, 139 R

[56] References Cited

U.S. PATENT DOCUMENTS

| | | | |
|---|---|---|---|
| 4,999,077 | 3/1991 | Drake et al. | 156/299 |
| 5,160,945 | 11/1992 | Drake | 346/140 R |
| 5,198,054 | 3/1993 | Drake et al. | 156/64 |

FOREIGN PATENT DOCUMENTS

| | | | |
|---|---|---|---|
| 2-265275 | 10/1990 | Japan | 257/724 |

OTHER PUBLICATIONS

Xerox Disclosure Journal, vol. 17 No. 5, pp. 305–308 Sep./Oct. 1992.

*Primary Examiner*—Benjamin R. Fuller

*Assistant Examiner*—Alrick Bobb

[57] ABSTRACT

A full width read and/or write assemblies, such as a full width thermal ink jet printbar, is disclosed, having materials with both a high thermal coefficient of expansion and a low thermal coefficient of expansion. A suitable adhesive which provides lateral give while firmly holding the respective components together provides dimensional stability to the printbar element having a low thermal coefficient of expansion when components having high thermal coefficient of expansion are assembled thereto. The flexible or floating mounting enabled by lateral give of the adhesive allows for the application of cost effective materials with a high thermal coefficient of expansion to be used for support functions such as, for example, circuit boards and ink manifolds. The flexible or floating mounting relieves shear stress cased by a differential in the expansion or contraction of materials having a different thermal coefficient of expansion. Since the thermal expansion of the various components expand and contract from a center location thereof, this center location is bonded by an adhesive which does not provide lateral give, so that alignment between parts are maintained while the remainder of the respective components float relative to each other and prevent thermally induced stresses which tend to cause warpage.

11 Claims, 3 Drawing Sheets

FULL WIDTH ARRAY READ OR WRITE BARS HAVING LOW INDUCED THERMAL STRESS

BACKGROUND OF THE INVENTION

This invention relates to full width array read or write bars and more particularly to such read or write bars assembled from components having materials with both high and low thermal coefficients of expansion that are coupled together in a manner to prevent internal thermal stress and consequent bar warpage while maintaining critical alignment therebetween.

It is well known in the reading and/or writing bar industry to assemble pagewidth raster input scanning (RIS) and raster output scanning (ROS) bars from relatively short RIS/ROS subunits placed end-to-end. Once assembled, the pagewidth RIS/ROS bars or scanning arrays have the requisite length and number of image processing elements to scan an entire line of information with a high image resolution. The subunits have either image reading arrays which comprise a succession of image sensing elements to convert a scanned image into electrical signals or image writing arrays which comprise a succession of light producing elements employed to produce latent images on image retentive surfaces or ink jet printheads to produce images from ejected ink droplets onto a recording medium, such as paper.

Typically, full width arrays experience significant thermal excursions during the fabrication process and during operation of such arrays. Thus, it is difficult to design each component in the package with low thermal expansion materials to match the thermal coefficient of expansion (TCE) of, for example, a silicon die containing either a plurality of image sensing elements or ink jet printheads. A printed wire board (PWB) capable of carrying high current, for example, has a relatively high TCE due to the dielectric material of the board itself and the high copper content retained on the board to carry current. In another example, the low cost polymers having relatively high coefficients of thermal expansion are used to manufacture ink supplying manifolds for thermal ink jet printheads. Finally, electrical connectors made from polymeric materials having the same high coefficients of thermal expansion are used to interconnect individual components comprising the complete array package. Consequently, few materials match the low TCE of the silicon die or the structural bar used in full width array thermal ink jet printheads. Therefore, when high TCE materials are coupled to low TCE materials, a thermal mismatch occurs that causes shear stress and strain during a thermal excursion. In the case-of a full width array thermal ink jet printbar or printhead, a thermal excursion takes place during the fabricating process (specifically, in the encapsulant cure process) that produces a printbar fabricated with built-in stress and warpage. Another thermal excursion occurs during the operation of a printbar, whereby the normal operating temperature exceeds the room temperature by approximately 30 degrees Centigrade. In either case, there is a tendency towards warpage of the printbar that causes a corresponding misplacement of marks on a copy sheet. Warpages on the order of 0.1 of an inch over an 11 inch wide printbar have been observed.

At the center of the fabricating process for full width array ink jet printheads is the unavoidable coupling of high TCE materials, such as printed wire boards and ink supply manifolds, with low TCE materials such as silicon die and a low TCE glass structural bar. Low TCE materials are critically important to the precision placement of marks on a copy sheet. High TCE materials are not dimensionally as critical, but instead support the function of the silicon die by providing the ink and electrical energy. It is important therefore, from a print quality standpoint, that the silicon and the low TCE glass experience minimal dimensional movement or warping during thermal excursions. The support function components, such as, for example, a printed wire board in the printbar assembly, can be more dimensionally variable than the printbar during thermal excursions because of the higher TCE, as long as the dimensional variability does not interfere with the support function. Thus, a printed wire board can expand or contract, and not interfere with the spot placement as long as it does not significantly affect the dimensions of the printbar and does not shift so much that the wire bonds between the two components are broken.

The prior art has failed to provide a means for fabricating a pagewidth scanning or imaging array that decouples high TCE materials from the dimensionally critical low TCE materials to prevent thermally induced stresses that cause corresponding bowing of or damage to the assembly.

U.S. Pat. No. 5,198,054 to Drake et al. discloses a process for fabricating reading and/or writing bars assembled from subunits, such as ink jet printhead subunits. At least two lengths of subunits are cut and placed on corresponding flat containers. An assembly robot places the subunits in a butted array on an alignment fixture and checks the positional error of the subunits as they are being assembled.

U.S. Pat. No. 5,160,945 to Drake discloses a pagewidth thermal ink jet printer. The printhead is of the type assembled from fully functional roofshooter type printhead subunits fixedly mounted on the surface of one side of a structural bar. A passageway is formed adjacent the bar side surface containing the printhead subunits with openings provided between the passageway and the ink inlets of the printhead subunits, mounted thereon so that ink supplied to the passageway in the bar maintains the individual subunits full of ink. The size of the printing zone for color printing is minimized because the roofshooter printhead subunits are mounted on one edge of the structural bar and may be stacked one on the other without need to provide space for the printhead subunits/or ink supply lines. In addition, the structural bar thickness enables the bar to be massive enough to prevent warping because of printhead operating temperatures.

U.S. Pat. No. 4,999,077 to Drake et al. discloses a method for fabricating a coplanar full width scanning array from a plurality of relatively short scanning subunits for reading and writing images. The subunits are fixedly mounted in an end-to-end relationship on a flat structural member with the subunits surfaces containing the scanning elements all being coplanar even though at least some of the subunits have varying thickness. This is accomplished by forming from a photopatternable thick film layer one or more keys on the subunit surface having the scanning elements and associated circuitry and positioning the keys into keyways produced from a photopatternable thick film layer on a flat surface of an alignment fixture. A conformal adhesive bonds a structural member to the assembled subunits to form the full width scanning array.

Xerox Disclosure Journal, Vol. 17, No. 5, pages 305–308, September/October 1992, discloses an encapsulation method for preventing damage to wire bonds between components in full width array devices having material with different thermal coefficients of expansion (TCE). The method comprises using two separate continuous beads of encapsulating material which encapsulates only the wire bond weld sites. This leaves the wires between the encapsulated weld sites free to move or flex without breaking or shearing the weld sites.

SUMMARY OF THE INVENTION

It is the object of the present invention to provide a full width read and/or write bar having low induced thermal stresses and a cost effective method of fabricating such bars.

It is another object of the present invention to provide a full width read and/or write bar from component assemblies having materials with a high thermal coefficient of expansion mounted onto materials having a low thermal coefficient of expansion, while maintaining critical dimensional alignment between component assemblies during temperature excursions encountered during fabrication and normal operation thereof.

In the present invention, a full width read or write bar fabricated from several assemblies with substantially different thermal coefficients of expansion is disclosed. The read or write bar is described as a full width array thermal ink jet printhead, though any full width array read or write bar using components with low thermal coefficients of expansion (TCE) combined with components having relatively high TCE could be used to describe the invention. A low thermal expansion glass substrate with silicon printheads attached thereto, an interconnect printed wire board (PWB), and a plastic manifold with ink are assembled to form a full width array printhead. By design, the substrate has an excellent thermal coefficient of expansion (TCE) match with the silicon printheads or die. However, the standard PWB and manifold materials have a much greater TCE than either the substrate or the silicon printheads. Although the interconnect PWB can be made from a material possessing a very close TCE match to the substrate, it is not economically feasible to do so. Therefore, the abutted silicon printhead subunits mounted on a low TCE glass structural bar to form the full width array uses a standard PWB board (having a TCE several times that of the glass substrate) and an ink manifold of commonly used plastic material that are bonded to the array with any suitable adhesive which has a high degree of "lateral compliance" while firmly holding the PWB and ink manifold thereto, so that the different components float relative to each other, so as to not cause thermally induced stresses that result in bowing of or damage to the final assembly. In the above embodiment, the interconnect PWB is adhered to the substrate adjacent the linear array of abutted printhead subunits, with a pressure sensitive adhesive that has a high degree of lateral compliance while firmly holding the pieces together. The electrical attachment between the silicon chips and the PWB is accomplished by means of a plurality of wire bonds or loops, so as to allow for lateral movement between each silicon chip and the PWB. The PWB is attached to the glass structural bar or substrate adjacent the abutted silicon printheads or die with a compliant adhesive material that is thick enough to compensate for relative changes in length in both the glass substrate and the PWB. Since the thermal expansion of the various components expand and contract about a center location thereof, this center location of the interfacing components is fixedly bonded together, so that alignment therebetween are maintained while the remainder of the respective interfacing components are free to float relative to each other through the bonding adhesive with the lateral compliance thereby preventing thermally induced stresses which tend to cause warpage.

A more complete understanding of the present invention can be obtained by considering the following detailed description in conjunction with the accompanying drawings, wherein like parts have the same index numerals.

DESCRIPTION OF THE PREFERRED EMBODIMENT

Figure 1:
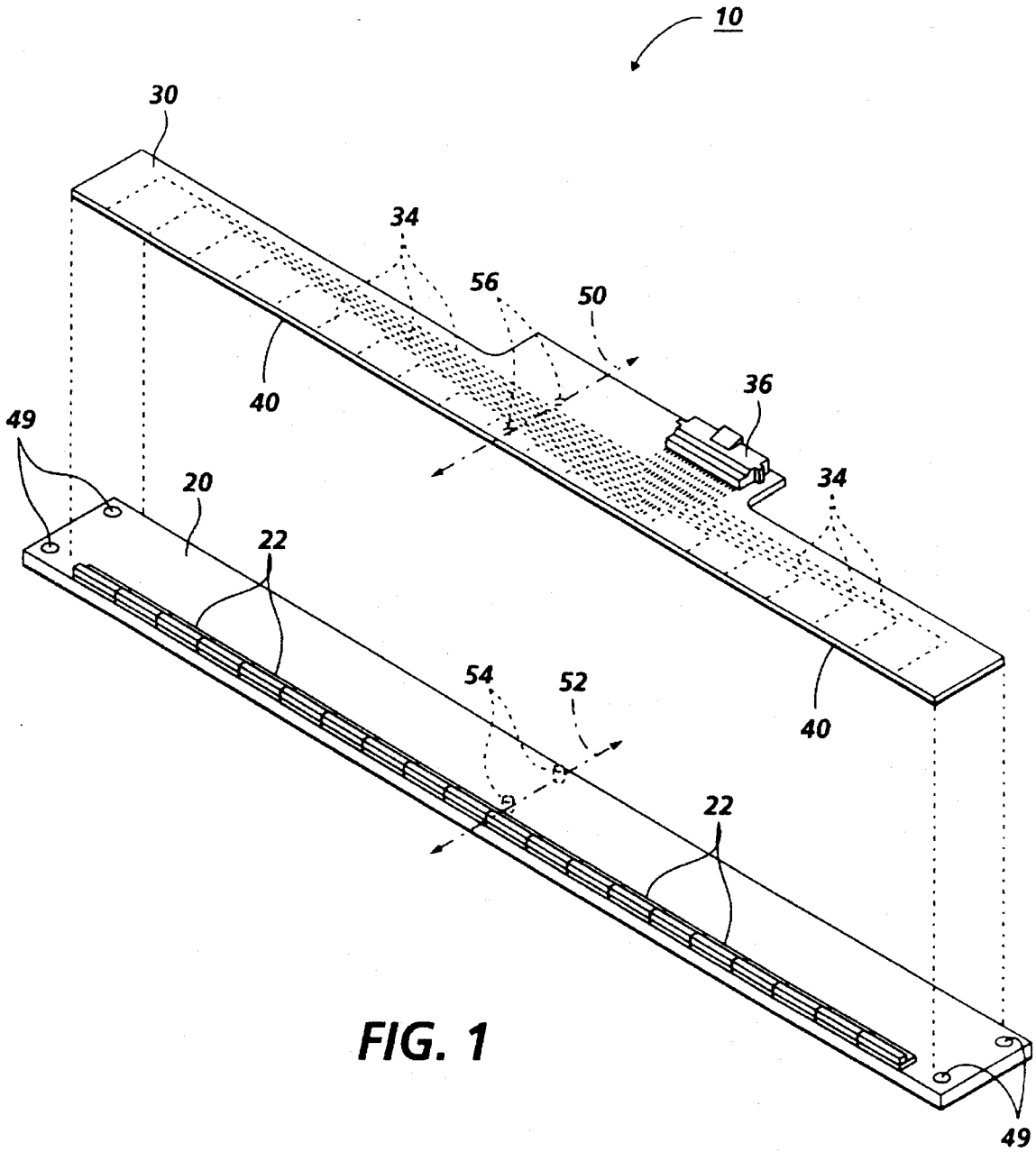
FIG. 1 is an exploded isometric view of the two major components of a full width read or write bar of the present invention, with the bar being depicted as a full width thermal ink jet printhead.

In FIG. 1 a full width read or write bar is shown comprising a glass structural bar 20 and a printed wiring board (PWB) 30. A plurality of silicon chips or die 22 are attached to structural bar 20. The composite, full width array 10 may be formed from either a series of image read arrays or a series of image write arrays. Thus, silicon chips or die 22 may be charged coupled devices or photodiodes to provide a composite read array for scanning document originals and converting the document image to electrical signals or pixels. Conversely, silicon chips 22 may also be a series of image write arrays, such as, for example, light emitting diodes, laser diodes, magnetic heads, or other printing heads, such as ink jet printheads to provide a composite write array on a suitable imaging member or recording medium, such as a photoreceptor for a xerographic copying system or paper for an ink jet printer in accordance with an image signal or pixel input. Regardless of whether the array is an image read or an image write array, the glass structural bar 20 has a thermal coefficient of expansion (TCE) to match substantially the TCE of the silicon chips 22. The printed wiring board (PWB) 30 has a relatively high TCE because of the dielectric material of the board itself and the high copper content retained on the board to carry the current representing either an electrical read image or write image.

Since it is not economically feasible, with the architecture shown in FIG. 1, to materially match the TCE of PWB 30 to the structural bar 20, the full width array 10 uses a standard PWB material such as, for example, 1/16 inch thick glass epoxy board overlaid with a 1.35 mil copper foil that forms a plurality of current carrying conductive strips or electrodes 34 that interconnect terminals or contact pads 24 and connector 36. The PWB 30 generally has a TCE of about $15\times10^{-6}$/°C. to $18\times10^{-6}$/°C., which is several times the TCE of the structural bar 20, which is about $3\times10^{-6}$/°C. to $3.5\times10^{-6}$/°C. The PWB 30 is not rigidly mounted to the glass substrate 20, except at its centerline 50. Instead, the PWB is bonded to the structural bar with any suitable adhesive which provides "lateral compliance", such as, for example, Adhesive 966, a pressure sensitive adhesive sold by 3M, so that the PWB floats on the structural bar 20, so as not to cause thermally induced stresses that result in the bowing or warpage of the final assembly. It has been observed that there will be no relative movement with temperature excursions between the structural bar 20 and the PWB 30 at the centerline 50 of the PWB when aligned with the centerline 52 of the structural bar, each indicated by dashed line. However, away from the centerline of the respective components, there will be relative movement between the parts, with the maximum relative movement being at the opposite ends of the full width array 10. Thus, at the centerlines 50, 52, the parts may be rigidly attached by, for example, pins 54 on the structural bar centerline 52 inserted in alignment holes 56 of the PWB, both shown in dashed line. Preferably, the confronting surfaces of the respective parts may be bonded by an unyielding stripe of adhesive 39 (FIG. 2) along the aligned centerline 50, 52, such as, for example, a UV curable adhesive, examples of which are Norland 61® UV Curing Adhesive sold by Norland Products Inc, and Loctite No. 375® sold by the Loctite Corporation. By fixing the centerline of the PWB to the centerline of the structural bar, the two parts remain aligned, even though the bonding adhesive layer 40 (FIGS. 1,4) sandwiched between the remainder of the confronting surfaces of the two components are permitted to float or laterally move due to the differences in dimension expansion and contraction with temperature. Thus, the fixing of the components at their centerlines maintains the alignment between the components, while the adhesive with the lateral compliance permits the difference in length changes to occur and to be equally divided on each side of the centerlines, thereby preventing the forces generated by the unequal lineal growth of the components from causing warping or bowing of the full width array.

The preferred embodiment is described using a pagewidth or full width array thermal ink jet printhead. Thus, the silicon chips 22 of FIGS. 1–4 are printhead subunits, sometimes referred to as die. The printhead subunits 22 are abutted end-to-end and bonded to the structural bar 20 in a manner similar to that disclosed in U.S. Pat. No. 5,198,054, incorporated herein by reference. Holes 49 in the opposing ends of the structural bar 20 may be used to mount the pagewidth printbar 10 in an ink jet printer (not shown).

In the preferred embodiment, the PWB 30 is attached to a Corning Pyrex® 7740 glass structural bar 20 with a narrow strip of a UV curable adhesive 39 (shown in dashed line in FIG. 2) placed along the interfacing centerlines 50, 52 having a thickness of about 0.1 mm and a width of about 5 mm and pressure sensitive adhesive (not shown) such as, for example, laminating Adhesive 966 manufactured by 3M covering the rest of the PWB surface interfacing with the structural bar. The strip of UV curable adhesive may alternatively be replaced with the pins 54 and alignment holes 56 in the PWB as shown in FIG. 1. The laminating pressure sensitive adhesive provides a high degree of lateral compliance while at the same time firmly holding the PWB 30 and the glass substrate 20 together. At a temperature excursion of approximately 50 degrees Centigrade, the amount of lateral movement allowed between the PWB 30 and the glass substrate 20, by the laminating adhesive is approximately 3 mils at each end of the array. The PWB 30 is spaced from the silicon printhead subunits by a distance which enables the wire bonding of the addressing electrode terminals 28 of the printhead subunits (see FIG. 3) and the terminals 24 of the electrodes 34 of the PWB. Alternatively, the glass structural bar may be Short Ternpax® 8330 sold by Schott Glaswerke, Germany. Both Corning Pyrex® 7740 and Short Ternpax® 8330 have a low TCE of about $3.25\times10^{-6}$ per degree Centigrade.

Figure 2:
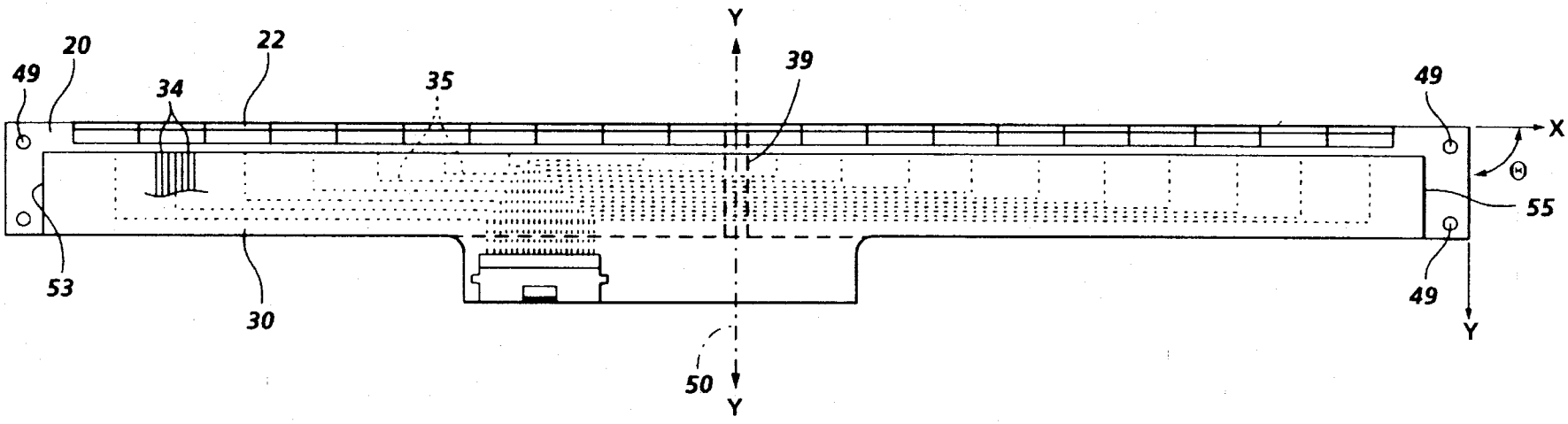
FIG. 2 is a plan view of the assembled full width read or write bar of FIG. 1.

Referring to the top view of the full width array printbar 10 in FIG. 2, there will be no relative movement with temperature excursions between the glass structural bar 20 and the PWB 30 at a center line 50, which center line is coincident with structural bar centerline 52, also identified as the Y axis. The plane of the pagewidth printbar is the X–Y plane as shown in FIG. 2. However, away from the centerline 50, there will be relative movement between the structural bar 20 and the PWB 30 with the maximum movement being at ends 53 and 55. Extensive experience has shown that the pressure sensitive 40 adhesive allows for stress relief without any detectable bowing of the structural bar 20 to occur. Because of the use of a means to rigidly attach the centerline 50 of the PWB 30, a component having high TCE, to the centerline 52 of the structural bar, a component having a low TCE that matches the silicon printhead subunits 22, the alignment between the abutted printhead subunits, which are also rigidly bonded to the structural bar 20, and the PWB is maintained even with temperature excursions that cause different relative dimensional expansion and contraction. The rigid bonding or other fastening means at the centerlines 50, 52 of the PWB and structural bar also prevent rotational drift in the X–Y plane as represented by the 90° angle Θ. Note that several electrical inputs are required for each printhead subunit 22, as indicated by PWB electrodes 34, only one set shown, while the remaining electrodes for each printhead subunit are depicted by a single phantom line 35.

Figure 3:
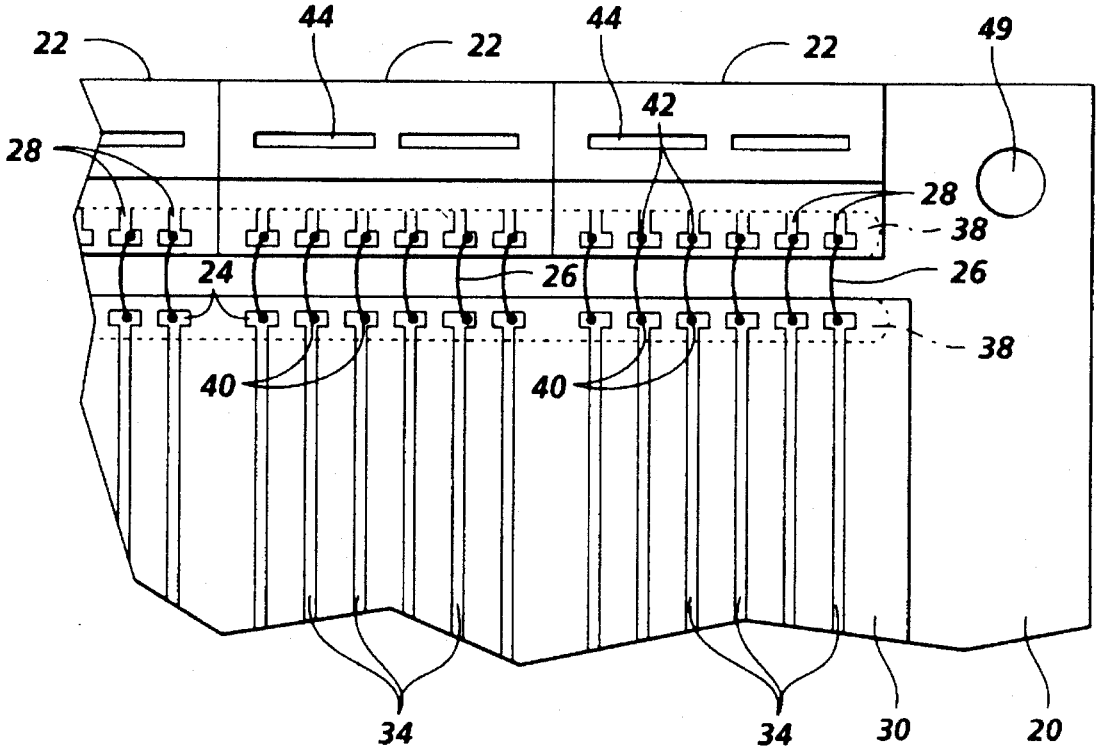
FIG. 3 is a partially shown, enlarged top view of a portion of the bar of FIG. 2, showing the wire bond weld sites and encapsulation thereof.
Figure 4:
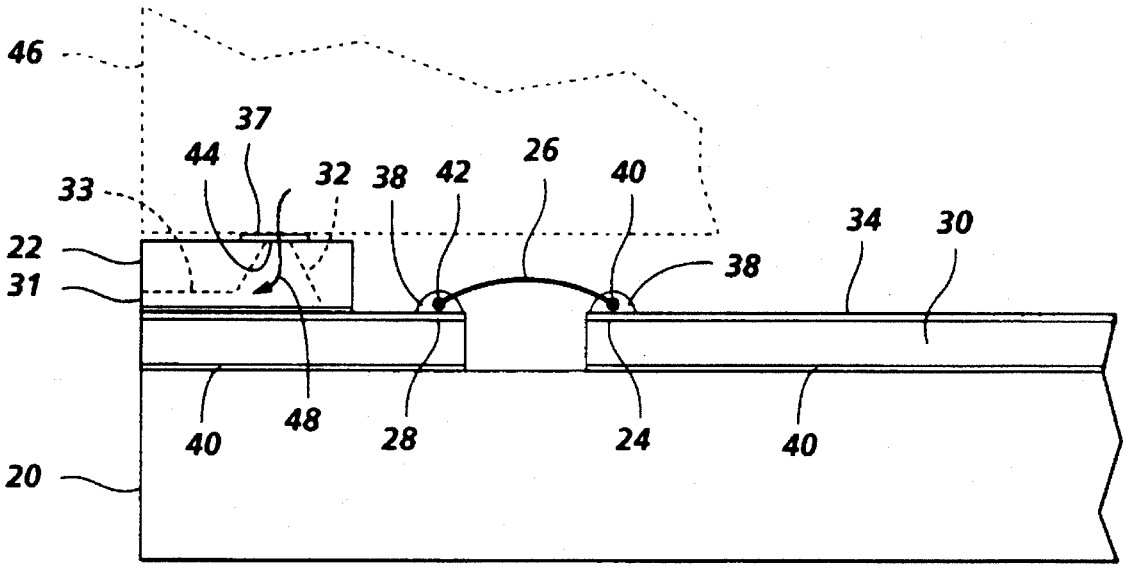
FIG. 4 is a side view of the wire bond weld sites and encapsulation of the bar shown in FIG. 3.

FIG. 3 and FIG. 4 depict the electrical attachment between the silicon printhead subunits 22 and the PWB 30. The wire bonding of a plurality of wire bonds or loops 26 between the two parts provide a means for lateral movement that eliminates stress and shear occurring between the pieces. FIG. 3 is a partially shown top view of the wire bond sites and FIG. 4 is a side view. Referring to FIG. 3 and FIG. 4, there is shown a plurality of wire bond sites or electrode terminals 24 on the PWB 30. The wire bond sites 24 are part of the 1.35 mil copper foil pattern (shown in FIG. 1) that form a plurality of current carrying conductive strips 34. The copper foil is overlaid with a layer of nickel (not shown) and has a top surface coating of gold (not shown). Similarly, there are a plurality of aluminum pads that comprise wire bond sites or addressing electrode terminals 28 on the silicon printhead subunits 22 mounted on the Pyrex® 7740 glass substrate 20. The wire loops 26 are comprised of separate lengths of aluminum wire that are separately welded to matingly interconnect pairs of wire bond sites 24 and 28. For example, one end of a wire loop 26 is terminated, to form a weld bond 40 on a PWB wire bond site 24, while the opposite end is terminated to form another weld bond 42, on a mating wire bond site 28 located on a silicon printhead subunit 22. A continuous bead 38 of encapsulating material such as, for example, silicone or polyurethane is shown in dashed line and is applied along the length of the PWB wire bond sites 24 to prevent wire bond corrosion at each terminating weld bond 40. The encapsulate is a soft, flexible material rather one being a rigid material. Another separate, continuous bead 38 of the same encapsulating material is likewise shown in dashed line and is applied along the length of the wire bond sites 28 on the silicon printhead subunits 22 that are mounted to the Pyrex® 7740 glass substrate 20. This method of using two separate encapsulating beads 38 instead of a single encapsulate (where the entire surface area comprising all of the bonding wires are enclosed by a continuous layer) prevents a transfer of mechanical stress to the bonding wires that correspondingly causes the wires to be sheared away from their respective bonding sites when temperature excursions cause relative movement between because the printhead subunits rigidly bonded to the TCE matching structural bar 20 have a low TCE and the PWB has a higher TCE.

In FIGS. 3 and 4, the printhead subunits 22 are shown to have ink inlets 44 through which ink (not shown) flows from an ink supply manifold 46, shown in phantom lines, as depicted by arrow 48. From the view in FIG. 4, each of the printhead subunits 22 has its reservoir 32 and channels 33 shown in dashed line which connect the nozzle 31 of the printhead subunit with the printhead subunit inlets 44. The manifold outlets (not shown) are hermetically sealed to the printhead subunit inlets 44 by seals 37.

It is, therefore, evident that there has been provided in accordance with the present invention, an improvement full width read write bar assemblies and method of fabrication thereof. Accordingly, it is intended to embrace all such alternatives, modifications and variations as fall within the spirit and broad scope of the appended claims.

We claim:

1. A full width array bar, comprising:

a structural bar of predetermined material having a predetermined thermal coefficient of expansion and having a length in one direction, the structural bar having at least one surface and a centerline perpendicular to the length direction thereof;

a plurality of subunits of predetermined material being linearly abutted and bonded end-to-end on the structural bar surface and along the length thereof, the subunits having a thermal coefficient of expansion closely matching the thermal coefficient of expansion of the structural bar;

a printed wiring board having a predetermined length in one direction, a centerline perpendicular to the PWB length direction, and a thermal coefficient of expansion higher than a thermal coefficient of the structural bar, the PWB having opposing surfaces with electrodes on one surface, the other surface of the PWB being aligned and mated with the structural bar surface, so that the centerline of the PWB the corresponding centerline of the and structural bar are aligned and the PWB is parallel to and spaced from the linearly abutted subunits;

means for rigidly attaching the PWB at the centerline thereof to the centerline of the structural bar; and an adhesive having a lateral compliance coated on the other surface of PWB, except at the centerline, prior to mating of the PWB with the structural bar.

2. The full width array bar of claim 1, wherein the subunits are thermal ink jet printhead subunits.

3. The full width array bar of claim 2, wherein the printhead subunits are primarily silicon.

4. The full width array bar of claim 3, wherein the structural bar is glass having a low thermal coefficient of expansion.

5. The full width array bar of claim 4, wherein the thermal coefficient of expansion of the glass structural bar is substantially matched to the thermal coefficient of expansion of silicon.

6. The full width array bar of claim 5, wherein the thermal coefficient of expansion of the glass structural bar is $3\times10^{-6}$ to $3.5\times10^{-6}$ per degree Centigrade.

7. The full width array bar of claim 5, wherein the means for rigidly attaching the PWB at the PWB centerline to the structural bar at the structural bar centerline is by a relatively narrow strip of adhesive located at the respective confronting centerline of the PWB and structural bar.

8. The full width array bar of claim 7, wherein the adhesive strip is a UV curable adhesive having a thickness of about 0.1 mm and a width along the centerline of the PWB of about 5 mm.

9. The full width array bar of claim 5, wherein the means for rigidly attaching the PWB at the PWB centerline to the structural bar at the structural bar centerline is by at least two pins rigidly attached to the structural bar at the centerline thereof and at least two alignment openings for receiving the pins located in the PWB at the PWB centerline.

10. The full width array bar of claim 1 wherein the subunits are read bars.

11. The full width array bar of claim 1 wherein the subunits are write bars.

* * * * *